US006840225B2

(12) United States Patent
Sandoval

(10) Patent No.: US 6,840,225 B2
(45) Date of Patent: Jan. 11, 2005

(54) FUEL INJECTOR ASSEMBLY

(75) Inventor: Fernando Sandoval, Waterloo, IA (US)

(73) Assignee: Deere & Company, Moline, IL (US)

( * ) Notice: Subject to any disclaimer, the term of this patent is extended or adjusted under 35 U.S.C. 154(b) by 204 days.

(21) Appl. No.: 10/254,962

(22) Filed: Sep. 24, 2002

(65) Prior Publication Data

US 2004/0056116 A1 Mar. 25, 2004

(51) Int. Cl.[7] ..... F02M 55/02
(52) U.S. Cl. ..... 123/469; 123/470
(58) Field of Search ..... 123/469, 468, 123/470, 467, 198 D; 285/14

(56) References Cited

U.S. PATENT DOCUMENTS 4,601,275 A * 7/1986 Weinand ..... 123/468
5,201,295 A * 4/1993 Kimberley et al. ..... 123/467
5,839,661 A * 11/1998 Iwanaga ..... 239/88
6,234,413 B1 5/2001 Greaney ..... 239/533.2
6,237,571 B1 * 5/2001 Harrison ..... 123/469
6,604,509 B1 * 8/2003 Hegner ..... 123/456

* cited by examiner

*Primary Examiner*—Mahmoud Gimie

(57) ABSTRACT

A fuel injector assembly includes a housing having a plurality of injector bores, a plurality of fuel feed bore, each intersecting a corresponding one of the injector bores, and a common return passage which communicates all the fuel feed bores with a fuel reservoir. A fuel injector is mounted in each of the injector bores. Each injector has a return fuel port which communicates return fuel to an exterior of the injector. A fuel feed member is mounted in each of the fuel feed bores. Each fuel feed member has a fuel feed passage which communicates pressurized fuel to a corresponding one of the injectors. An outer surface of each fuel feed member and a wall of each fuel feed bore forms a return chamber which is communicated with a corresponding return fuel port and which is communicated with the common return passage.

4 Claims, 2 Drawing Sheets

FUEL INJECTOR ASSEMBLY

BACKGROUND OF THE INVENTION

The present invention relates to a fuel injector assembly for an engine.

A solenoid-operated fuel injector for diesel engines is described in U.S. Pat. No. 5,839,661. Such an injector includes a solenoid-operated valve member and a needle valve. The solenoid-operated valve member selectively establishes fluid communication between a fuel inlet and a fuel outlet. The needle valve is moved to selectively open and close a spray hole through which the fuel is sprayed. Such an injector also includes a fuel return passage and a fuel outlet which is communicated with a fuel reservoir. Some current production engines require multiple separate fuel return passages to be formed in the engine housing, and multiple separate external fuel return lines, one for each separate fuel injector. Accordingly, it is desired to reduce engine complexity by eliminating the need for such multiple separate fuel return passages and separate external return lines.

SUMMARY

Accordingly, an object of this invention is to provide a simple fuel injector assembly.

These and other objects are achieved by the present invention, wherein an engine fuel injector assembly includes a housing having a plurality of fuel injector bores, in each of which is mounted a fuel injector. The housing also has a plurality of fuel feed bores, in each of which is mounted a fuel feed member. Each fuel feed member engages a side of a corresponding injector and communicates pressurized fuel thereto. An outer surface of each fuel feed member and a wall of each fuel feed forms a chamber which is communicated with a fuel return passage of each injector. A common return passage communicates all the fuel feed bores with a single external leak-off port to which may be attached a single external fuel return line.

DETAILED DESCRIPTION

Figure 1:
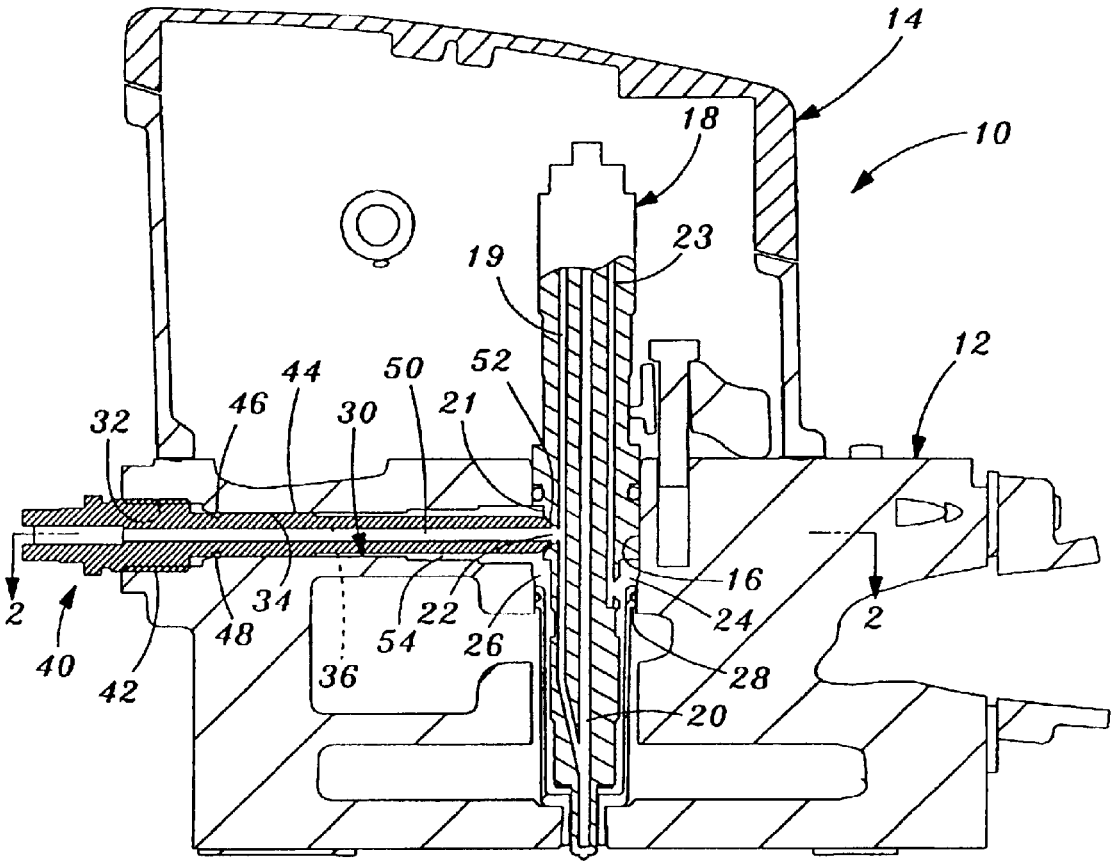
FIG. 1 is a simplified sectional view of a fuel injector assembly according to the present invention.
Figure 2:
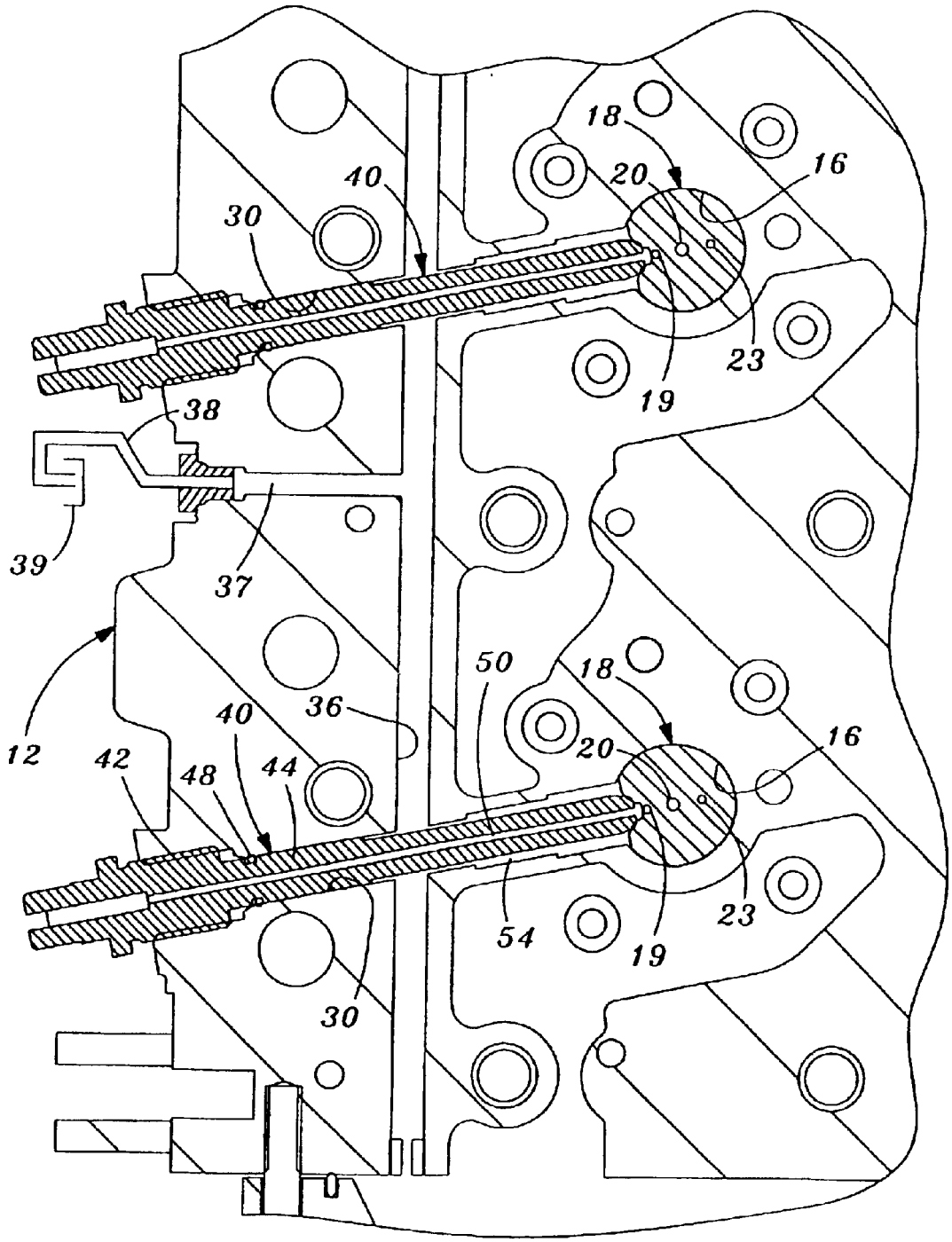
FIG. 2 is a view taken along lines 2—2 of FIG. 1.

Referring to FIGS. 1 and 2, a fuel injector assembly 10 includes an engine housing 12 to which is mounted a head cover 14. Housing 12 includes a plurality of fuel injector bores 16, one of which is shown in FIG. 1. Each bore 16 receives a conventional fuel injector 18 for injecting pressurized fuel into an engine cylinder (not shown). The injector 18 includes a supply passage 19, a central axial bore 20 which receives a control piston (not shown) and a return passage 23. A recess 21 is formed in one side of the injector. A radially extending feed passage 22 communicates recess 21 with supply passage 19. A radially extending leak-off passage 24 communicates return passage 23 with an outer surface of the injector 18 and to an annular chamber 26 which is formed between the injector 18 and a wall 28 of the bore 16. Such an injector is described in U.S. Pat. No. 5,839,661, and includes a solenoid operated valve (not shown) which controls fuel injection events and which controls communication of return fuel to the return passage 23.

A plurality of fuel feed bores 30 extend through the housing 12, a pair of which are visible in FIG. 2. Each bore 30 has an axis which is substantially perpendicular to the axis of the corresponding injector bore 16, and an inner end of each bore 30 opens into or intersects with the corresponding bore 16. Each bore 30 includes an outer larger diameter threaded portion 32 and a smaller diameter inner portion 34. As best seen in FIG. 2, the housing 12 also includes a single common fuel leak-off or return passage 36 which communicates with all of the bores 30, and which communicates with a single outlet passage 37 and a single external return line 38 which communicates with a fuel reservoir 39.

A fuel feed member 40 is mounted in each bore 30. Each fuel feed member 40 includes a larger diameter portion 42 with external screw threads for threadably engaging the corresponding threaded portion 32 of bore 30. Fuel feed member 40 also includes a smaller diameter portion 44 which slidingly engages bore portion 34. An annular groove 46 is formed in portion 44 for receiving an annular seal member 48. Fuel feed member 40 includes a central axial bore 50 which extends therethrough. The outer end of bore 50 receives pressurized fuel from a source of pressurized fuel (not show). An inner end or tip 52 of member 40 is received by and engages a wall of recess 21 so that bore 50 is communicated with passages 22 and 19. The outer surface of member 40 and the wall of bore 30 form an axially extending annular chamber 54 which is communicated with passage 36 and with annular chamber 26. Thus, a leak-off path for excess fuel is provided by passage 24, chamber 26, chamber 54, passages 36 and 37 and line 38.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A fuel injector assembly comprising:

a housing having a plurality of injector bores extending therethrough, a plurality of fuel feed bores, each intersecting a corresponding one of the injector bores, and a common return passage which communicates all the fuel feed bores with a fuel reservoir;

a plurality of fuel injectors, each mounted in a corresponding one of the injector bores and each having a return fuel port communicating return fuel to an exterior of the injector;

a plurality of fuel feed members, each mounted in a corresponding one of the fuel feed bores, each fuel feed member having a fuel feed passage which communicates pressurized fuel to a corresponding one of the injectors, an outer surface of each fuel feed member and a wall of each fuel feed bore forming a return chamber which is communicated with a corresponding return fuel port and which is communicated with the common return passage.

2. The fuel injector assembly of claim 1, wherein:

each fuel feed member comprises a hollow cylindrical member having a larger diameter portion and a smaller diameter portion, the larger diameter portion slidingly engaging the wall of the fuel feed bore, the smaller diameter portion and the wall of the fuel feed bore forming an annular chamber therebetween.

3. The fuel injector assembly of claim 1, wherein:

an end of the smaller diameter portion engages a side of the fuel injector.

4. The fuel injector assembly of claim 1, further comprising:

a single fuel return line external to the housing and communicating the common return passage with the reservoir.

* * * * *